US011186937B2

(12) United States Patent
Lv et al.

(10) Patent No.: US 11,186,937 B2
(45) Date of Patent: Nov. 30, 2021

(54) WASHING MACHINE AND CONTROL METHOD THEREOF

(71) Applicant: QINGDAO HAIER WASHING MACHINE CO., LTD., Shandong (CN)

(72) Inventors: Peishi Lv, Shandong (CN); Gangjin Zhang, Shandong (CN); Yun Tian, Shandong (CN); Jianshe Liu, Shandong (CN); Chunxia Zhou, Shandong (CN)

(73) Assignee: QINGDAO HAIER WASHING MACHINE CO., LTD., Shandong (CN)

( * ) Notice: Subject to any disclaimer, the term of this patent is extended or adjusted under 35 U.S.C. 154(b) by 239 days.

(21) Appl. No.: 16/462,588

(22) PCT Filed: Nov. 21, 2017

(86) PCT No.: PCT/CN2017/112093
§ 371 (c)(1),
(2) Date: May 21, 2019

(87) PCT Pub. No.: WO2018/095310
PCT Pub. Date: May 31, 2018

(65) Prior Publication Data

US 2020/0063317 A1 Feb. 27, 2020

(30) Foreign Application Priority Data

Nov. 22, 2016 (CN) ..... 201611028294.4

(51) Int. Cl.
*D06F 37/26* (2006.01)
*D06F 23/04* (2006.01)
(Continued)

(52) U.S. Cl.
CPC ..... *D06F 37/263* (2013.01); *D06F 23/04* (2013.01); *D06F 37/02* (2013.01); *D06F 39/083* (2013.01); *D06F 2204/084* (2013.01)

(58) Field of Classification Search
CPC ..... D06F 37/263; D06F 37/02; D06F 23/04; D06F 39/083; D06F 2204/084
See application file for complete search history.

(56) References Cited

U.S. PATENT DOCUMENTS 5,152,159 A 10/1992 Kabeya et al.

FOREIGN PATENT DOCUMENTS

CN 103898708 A 7/2014
CN 106637795 A 5/2017
(Continued)

OTHER PUBLICATIONS

CN103898708A—Machine translation (Year: 2014).*
(Continued)

*Primary Examiner* — Tinsae B Ayalew
(74) *Attorney, Agent, or Firm* — Buchanan Ingersoll & Rooney PC

(57) ABSTRACT

The disclosure discloses a washing machine and a control method thereof; the washing machine comprises an outer barrel, an inner barrel an inner barrel shaft drainage holes are formed in the bottom of the inner barrel; a sealing device is arranged at the outside of the bottom of the inner barrel; the sealing device comprises a sealing component and a pull ring component which sleeve on the inner barrel shaft; the sealing component is arranged at the bottom of the inner barrel and is capable of rotating along with the inner barrel; the pull ring component is connected to the sealing component in a relatively rotating mode and the sealing component, pulled by the pull ring component, can do axial motion along the inner barrel.

9 Claims, 6 Drawing Sheets

(51) Int. Cl.
*D06F 37/02* (2006.01)
*D06F 39/08* (2006.01)

(56) References Cited

FOREIGN PATENT DOCUMENTS

| | | | |
|---|---|---|---|
| CN | 106757963 | A | 5/2017 |
| CN | 107190457 | A | 9/2017 |
| CN | 107268236 | A | 10/2017 |
| GB | 2242444 | A | 10/1991 |

OTHER PUBLICATIONS

International Search Report (PCT/ISA/210) dated Feb. 9, 2018, by the Chinese Patent Office as the International Searching Authority for International Application No. PCT/CN2017/112093.

* cited by examiner

WASHING MACHINE AND CONTROL METHOD THEREOF

TECHNICAL FIELD

The present disclosure relates to the technical field of clothes washing equipment, and in particular to a cleaning-free water-saving washing machine and a control method thereof.

BACKGROUND

At present, the washing machine comprises a shell as well as an outer barrel and an inner barrel which is arranged in the shell; and the inner barrel is rotatably arranged in the outer barrel. In order to achieve a function of dewatering clothes, drainage holes are fully distributed in the barrel wall of the inner barrel, so that washing water can flow to the space between the inner barrel and the outer barrel from the dewatering holes during clothes washing, and the washing water cannot be thoroughly used, causing waste of water resources.

In addition, dirt can grow on the outer wall of the inner barrel and the inner wall of the outer barrel, as well as in the space between the inner barrel and the outer barrel due to a problem of water storage between the inner barrel and the outer barrel, resulting in pollution of users' clothes and serious influence to clothes washing experience of users.

In order to solve the problem, the main structural characteristic of the current clothes washing machine is that the barrel wall of inner barrel is free from holes; therefore, only the inner barrel has water, and the water in the inner barrel cannot flow to the space between the inner barrel and outer barrel during washing, so that water consuming amount of clothes washing is reduced, and moreover, dirt breeding between the inner barrel and the outer barrels is avoided; and subsequently, pollution to clothes is prevented, a washing effect is enhanced and users' experience is improved.

The washing machine, which avoids water between the inner barrel and the outer barrel during washing and is free from holes in the barrel wall of the inner barrel, cannot achieve drainage by an existing drainage way; moreover, after a period of use, such impurities as sand, which are caused after washing, cannot be timely discharged since the inner barrel is free from holes, causing influence to users' clothes washing effect.

In view of this, the present disclosure is provided.

SUMMARY

In order to solve the problem, the first purpose of the present disclosure is to provide a cleaning-free water-saving washing machine; specifically, the technical solution as follows is adopted:

A cleaning-free water-saving washing machine, comprising:

an outer barrel;

an inner barrel, rotatably arranged in the outer barrel; and an inner barrel shaft, connected to the inner barrel so as to drive the inner barrel to rotate;

during a washing or a rinsing process, the inner barrel serving as a water storage barrel, and a space between the inner barrel and the outer barrel being free from water;

a drainage hole is formed in the bottom of the inner barrel; a sealing device is arranged at an outside of the bottom of the inner barrel; the sealing device comprises a sealing component sleeving on the inner barrel shaft and a pull ring component; the sealing component is installed at the bottom of the inner barrel and is capable of rotating along with the inner barrel; the pull ring component is connected with the sealing component in a relatively rotating mode; and the sealing component, pulled by the pull ring component, is capable of doing axial motion along the inner barrel, so that the drainage hole is controlled to be opened or closed.

Furthermore, the inner barrel comprises an inner barrel bottom and an inner barrel flange which is connected to the inner barrel bottom; a connecting portion for connecting with the inner barrel shaft, is arranged in a center of the inner barrel flange; and the drainage hole is formed in the inner barrel bottom and/or the inner barrel flange outside the connecting portion.

Furthermore, the sealing component comprises a sealing jacket; the sealing jacket sleeves on the inner barrel shaft; the sealing jacket is arranged at the outside of the bottom of the inner barrel, is capable of doing axial motion along the inner barrel; and the sealing jacket is provided with sealing plug which is matched with the drainage hole.

Furthermore, the sealing jacket comprises an annular jacket body and a plurality of connecting arms arranged along a circumferential direction of the annular jacket body; the annular jacket body sleeves on the inner barrel shaft; mounting holes are formed in the connecting arms; and the sealing plug is arranged in the annular jacket body;

the sealing component further comprises a columnar mounting element and elastic piece; the sealing jacket is installed at the outside of the bottom of the inner barrel by the columnar mounting element running through the mounting holes; and a first end of the elastic piece is fixed, and a second end abuts against the sealing jacket so as to close the drainage hole.

Furthermore, a compression spring is as the elastic piece, the compression spring sleeves on the columnar mounting elements; a first end of the compression spring abuts against the columnar mounting element, and a second end abuts against the connecting arm of the sealing jacket.

Furthermore, the pull ring component comprises an annular body and pull rods; the annular body sleeves on the sealing jacket; the sealing jacket is provided with a limiting portion for preventing the annular body from escaping along an axial direction of the inner barrel shaft; the pull rods are distributed along a circumferential direction of the annular body; a first end of each pull rod is connected to the annular body, and a second end of the pull rod is connected with a driving device, for driving the pull rods to do axial motion along the inner barrel.

Furthermore, the driving device is arranged at the outside of the bottom of the outer barrel; guide pillar holes are formed in the bottom of the outer barrel; the pull rods are connected to the driving device through the guide pillar holes respectively; and corrugated sealing sleeves, are arranged between the pull rods and the guide pillar holes for sealing.

Furthermore, the driving device comprises an electromagnetic coil and an annular magnet coaxially arranged with the electromagnetic coil; and the pull rods are connected to the annular magnet.

Furthermore, a part of a sidewall of the inner barrel, lower than the highest water level of the washing machine, is a hole-free barrel wall.

The second purpose of the present disclosure is to provide a control method of the cleaning-free water-saving washing machine; specifically, the technical solution as follows is adopted:

A control method of the cleaning-free water-saving washing machine prescribed by any one embodiment mentioned above, comprising:

in a washing or a rinsing process of the washing machine, closing the drainage hole by the sealing component, and keeping a space between the inner barrel and the outer barrel under a water-free state;

in a drainage process of the washing machine, controlling the pull ring component to do axial motion along the inner barrel, pulling the sealing component to move by the pull ring component, and opening the drainage hole to conduct drainage; and in a dewatering process of the washing machine, resetting the sealing component so as to close the drainage hole.

According to the cleaning-free water-saving washing machine provided by the present disclosure, in the washing or a rinsing process, the inner barrel is filled with water, while the space between the inner barrel and the outer barrel is free from water, namely the inner barrel of the washing machine of the present disclosure is a water-leakage preventing inner barrel that the barrel wall is free from holes, and the water, which is stored in the inner barrel, is used for washing clothes. Therefore, water consuming amount of clothes washing is reduced, and moreover, dirt growth between the inner barrel and the outer barrel is avoided; and subsequently, pollution to clothes is prevented, washing effect is enhanced and users' experience is improved.

According to the cleaning-free water-saving washing machine provided by the present disclosure, the drainage holes are arranged in the bottom of the inner barrel and are opened/closed under the control of the sealing device, so that the inner barrel is filled with water while the space between the inner barrel and the outer barrel is free from water in the washing or a rinsing process of the washing machine.

According to the present disclosure, the sealing component of the sealing device is arranged on the inner barrel and is capable of rotating along with the inner barrel, so that the sealing component and the drainage holes are relatively fixed; therefore, instead of conducting a locating operation, it needs to pull the sealing component to do axial motion along the inner barrel so as to close/open the drainage holes, which is simple and convenient and is easy to implement. The pull ring component sleeves the outside of the sealing component, and rotation of the sealing component along with the inner barrel is not affected; the sealing component is pulled to do motion only when the sealing component is pulled by the pull ring component along the axial direction of the inner barrel, so that the drainage holes are opened to conduct drainage; and the sealing component is not affected from rotating along with the inner barrel when the sealing component is pulled by the pull ring component.

Therefore, the sealing device of the present disclosure is simple in structure and is easy to implement; implementation cost can be effectively reduced; and a good market prospect can be achieved.

According to the control method of the cleaning-free water-saving washing machine of the present disclosure, in the washing or a rinsing process, the pull ring component does not conduct actions and the sealing component is rotated along with the inner barrel, so that the drainage holes are kept closed and the space between the inner barrel and the outer barrel is free from water; in the drainage process, the pull ring component, under tension, is driven to do axial motion along with the inner barrel, so as to pull the sealing component to open the drainage holes to achieve drainage; and in the dewatering process, the pull ring component is stopped from bearing force and the sealing component is reset, so that the drainage holes are kept closed.

Figure 1:
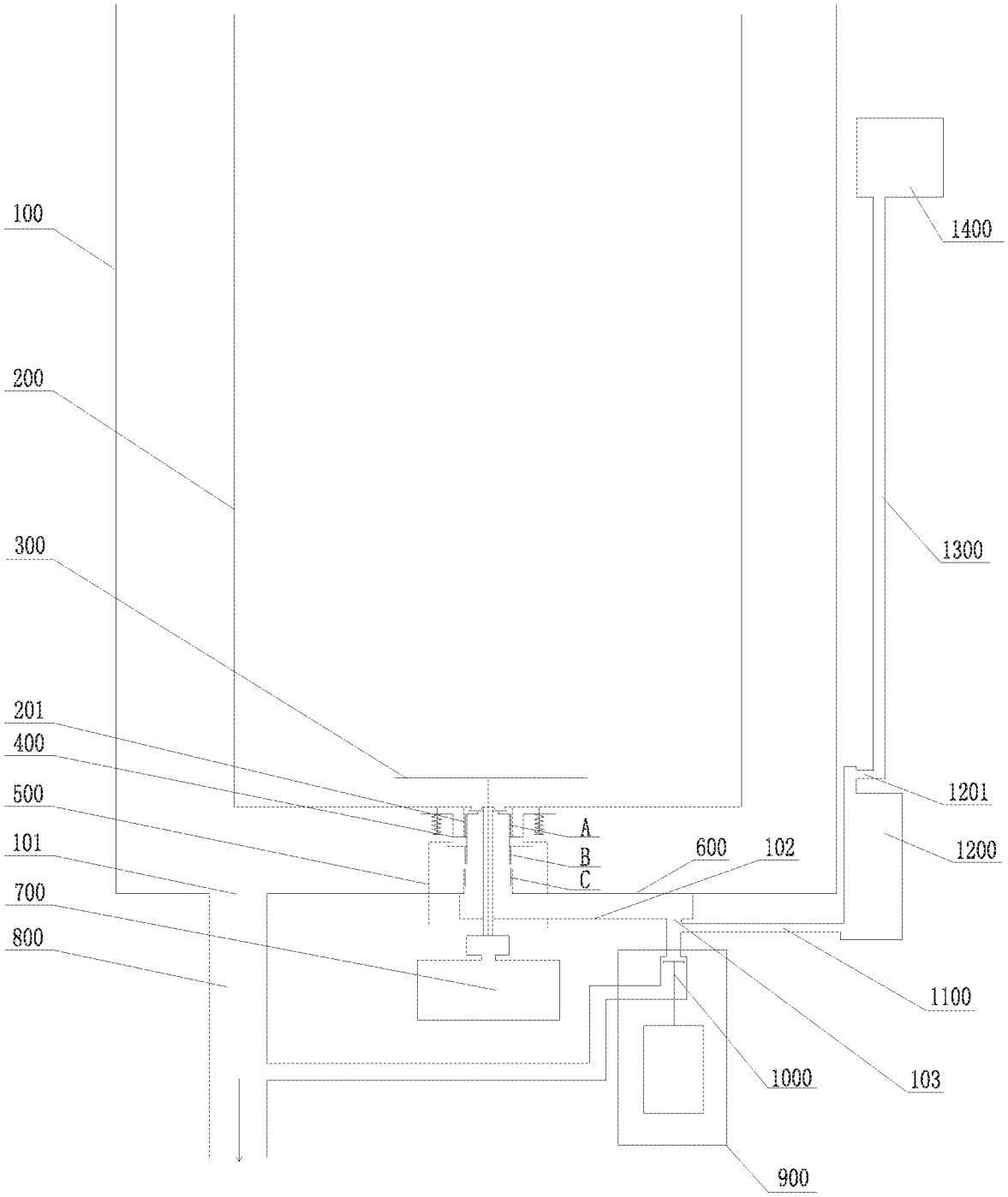
FIG. 1 is a schematic diagram of a cleaning-free water-saving washing machine provided by the present disclosure.

As shown in the attached drawings: 100—outer barrel; 101—drainage port; 102—sealing groove; 103—first drainage port; 104—mounting hole for inner barrel shaft; 200—inner barrel; 201—annular sealing rib; 202—columnar mounting element; 203—inner barrel flange; 204—drainage hole; 300—pulsator; 400—sealing jacket; 401—connecting arm; 402—convex ring, 403—upper annular inner jacket body, 405—mounting hole, 406—upper annular outer jacket body, 407—sealing plug, 408—annular groove; 500—pull ring component; 501—annular body; 502—limiting bulge; 503—pull rod; 504—limiting wall; 600—sealing box cover; 601—connecting port; 602—box cover; 700—reduction clutch; 701—pulsator shaft; 702—inner barrel shaft; 800—drainage pipe; 900—traction motor; 1000—first drainage valve; 1100—connecting pipe; 1200—air chamber; 1201—air chamber nozzle; 1300—pressure pipe; 1400—water level sensor; 1500—electromagnetic coil; 1600—fastening nut; 1700—compression spring; 1800—sealing strip; 1900—corrugated sealing sleeve; 2000—annular magnet.

DETAILED DESCRIPTION OF EMBODIMENTS

The cleaning-free water-saving washing machine and the control method thereof provided by the present disclosure will be described in details in combination with attached drawings.

Embodiment I

Shown as FIG. 1-FIG. 6, the cleaning-free water-saving washing machine provided by the embodiment comprises:

an outer barrel 100;

an inner barrel 200, which is arranged rotatably in the outer barrel 100; and an inner barrel shaft 702, which is connected to the inner barrel 200 so as to drive the inner barrel 200 to rotate;

during a washing or a rinsing process, the inner barrel 200 serves as a water storage barrel, and a space between the inner barrel 200 and the outer barrel 100 is free from water;

drainage holes 204 are formed in the bottom of the inner barrel 200; a sealing device is arranged at the outer side of the bottom of the inner barrel 200; the sealing device comprises a sealing component and a pull ring component 500 which sleeve the outside of the inner barrel shaft 702; the sealing component is arranged at the bottom of the inner barrel 200 and is capable of rotating along with the inner barrel 200; the pull ring component 500 is connected to the sealing component in a relatively rotating mode; and the sealing component, pulled by the pull ring component 500, does axial motion along the inner barrel, so that the drainage holes 204 is opened or closed.

According to the embodiment, the drainage holes 204 are kept closed by the sealing component in the washing or a rinsing process, so that washing water is prevented from entering a space between the inner barrel 200 and the outer barrel 100; therefore, dirt is prevented, and pollution to users' clothes is avoided. In the drainage process, the pull ring component, under tension, is driven to do axial motion along the inner barrel, so as to pull the sealing component to open the drainage holes 204; therefore, drainage is achieved, and moreover, such impurities as sand, which are generated in the washing process, is discharged and the interior of the inner barrel is kept clean.

According to the embodiment, the sealing component of the sealing device is arranged on the inner barrel 200 and is capable of rotating along with the inner barrel 200, so that the sealing component and the drainage holes 204 are relatively fixed; therefore, instead of conducting a locating operation, it only needs to pull the sealing component 500 to do axial motion along the inner barrel so as to close or open the drainage holes 204, which is simple and convenient and is easy to implement. The pull ring component 500 sleeves the outside of the sealing component, and rotation of the sealing component along with the inner barrel is not affected. The sealing component is pulled to do motion only when the sealing component is pulled by the pull ring component along the axial direction of the inner barrel, so that the drainage holes 204 are opened to conduct drainage. And the sealing component is not affected from rotating along with the inner barrel when the sealing component is pulled by the pull ring component 500.

According to the embodiment, the sealing device, during the washing process, is under such a state that the pull ring component 500 is not applied with force, the drainage holes 204 are closed by the sealing component, and the pull ring component 500 sleeves the outside of the sealing component and the pull ring component 500 and the sealing component are arranged at an interval; therefore, the drainage holes 204 are kept closed when the sealing component is rotated along with the inner barrel 200, and the sealing component fails to make into contact with the pull ring component 500, so as to avoid friction and noise.

Figure 2:
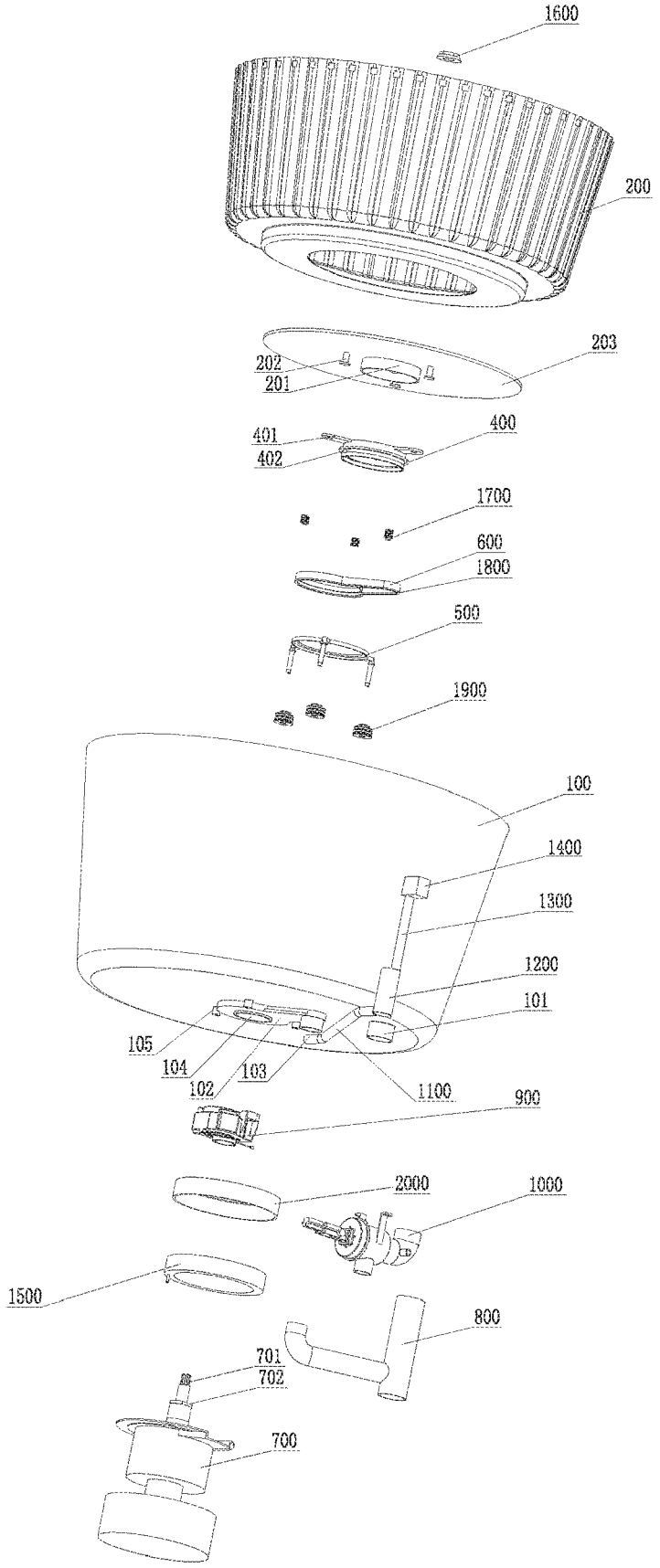
FIG. 2 is an explosive view of a cleaning-free water-saving washing machine provided by the present disclosure.
Figure 3:
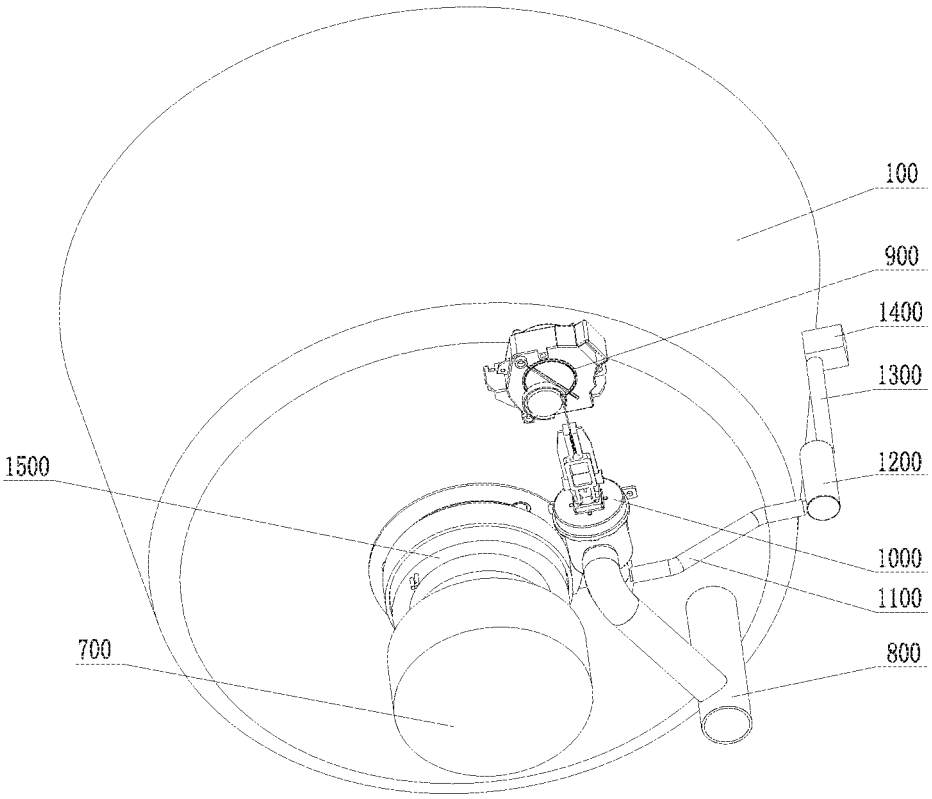
FIG. 3 is a bottom view of the inner and outer barrel mounting structure of a cleaning-free water-saving washing machine provided by the present disclosure.
Figure 4:
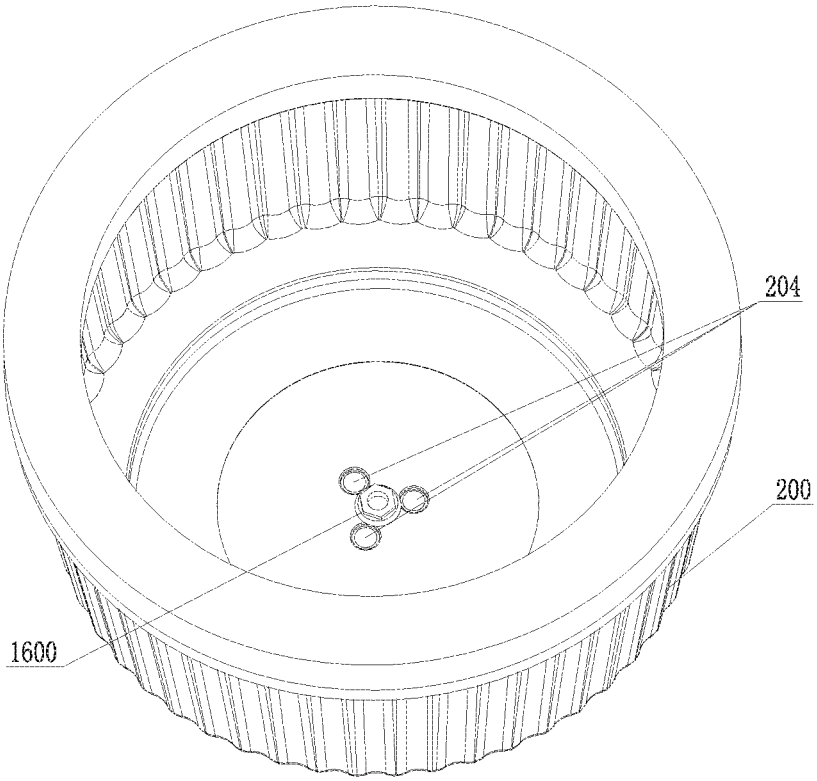
FIG. 4 is a top view of the inner barrel mounting structure of a cleaning-free water-saving washing machine provided by the present disclosure.
Figure 5:
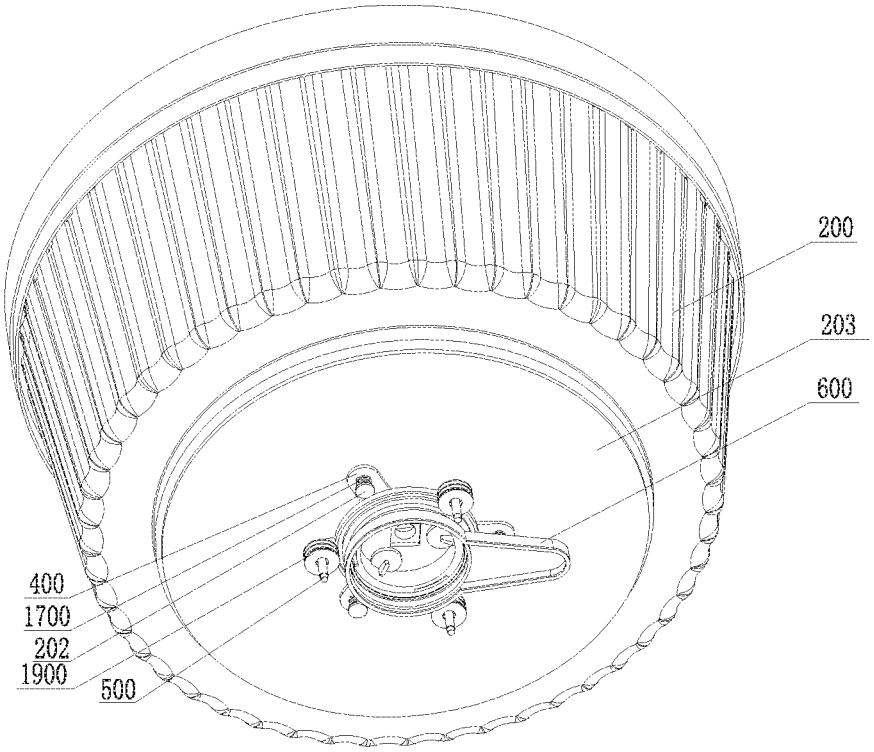
FIG. 5 is a bottom view of the inner barrel mounting structure of a cleaning-free water-saving washing machine provided by the present disclosure.
Figure 6:
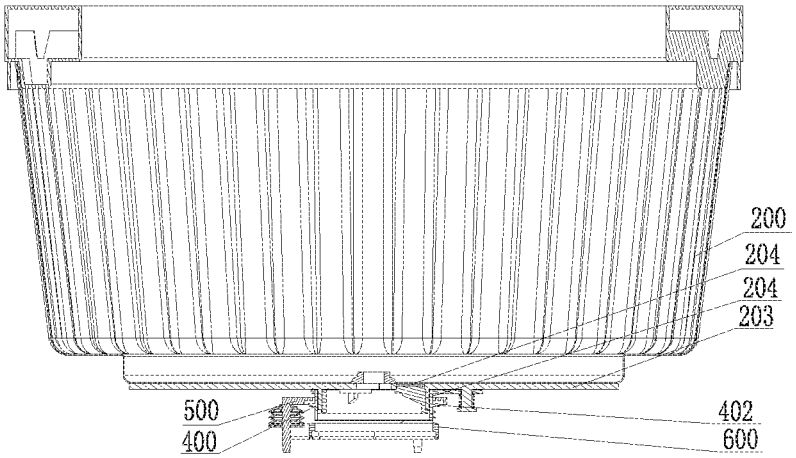
FIG. 6 is a section view of the inner barrel mounting structure of a cleaning-free water-saving washing machine provided by the present disclosure.
Figure 7:
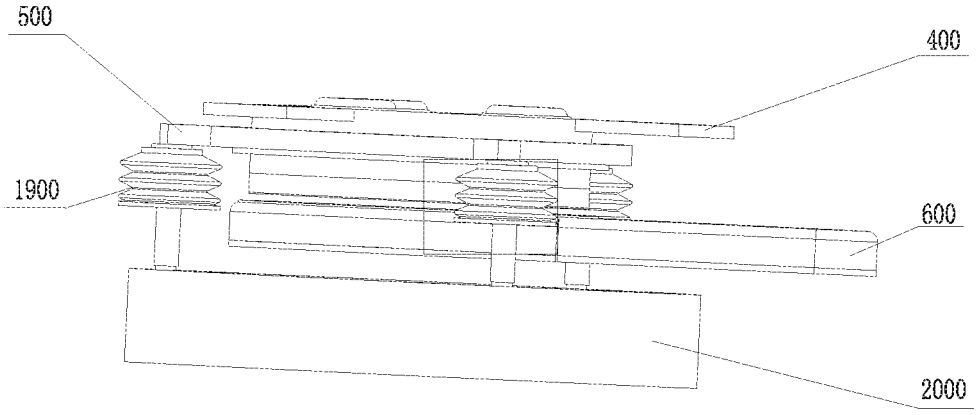
FIG. 7 is an assembly diagram of a sealing device of a cleaning-free water-saving washing machine provided by the present disclosure.

Shown as FIG. 2, according to the cleaning-free water-saving washing machine provided by the embodiment, the inner barrel 200 comprises an inner barrel bottom and an inner barrel flange 203 which is connected to the inner barrel bottom. A connecting portion, which is used for connecting the inner barrel shaft 702, is arranged in the center of the inner barrel flange 203. And the drainage holes 204 are arranged in the inner barrel bottom outside the connecting portion and/or on the inner barrel flange 203. According to the embodiment, the drainage holes 204 are arranged in the part, outside the region connected to the inner barrel shaft 702, of the bottom of the inner barrel 200, so that the drainage holes can fit to the sealing component which sleeves the outside of the inner barrel shaft 702.

Preferably, the connecting portion is a speed reducer mounting hole which is arranged in the center of the inner barrel flange 203; the drainage holes 204 are arranged on the outer circle of the speed reducer mounting hole. And preferably, 1-6 drainage holes 204 are arranged, so as to drainage.

As a preferred implementation mode of the embodiment, the sealing component comprises a sealing jacket 400, the sealing jacket 400 sleeves the outside of the inner barrel shaft 702. The sealing jacket 400 is arranged at the outside of the bottom of the inner barrel 200 in a mode of being capable of doing axial motion along the inner barrel; and the sealing jacket 400 is provided with sealing plugs 407 which are matched with the drainage holes 204.

Figure 8:
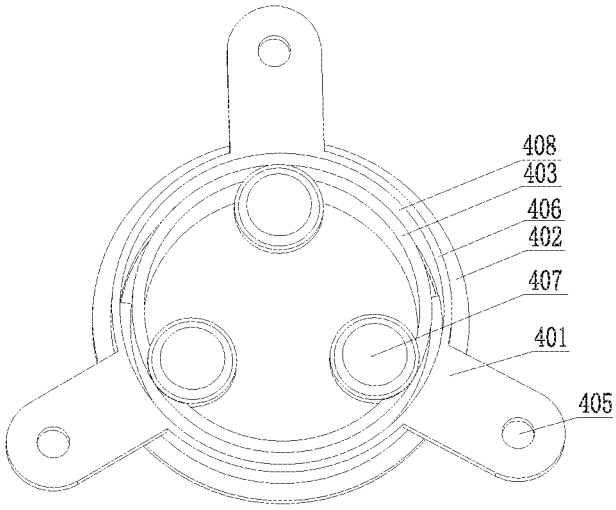
FIG. 8 is a top three-dimensional structural diagram of a sealing jacket of a cleaning-free water-saving washing machine provided by the present disclosure.
Figure 9:
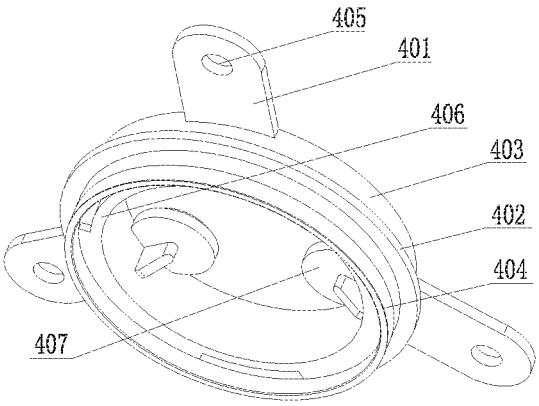
FIG. 9 is a bottom three-dimensional structural diagram of a sealing jacket of a cleaning-free water-saving washing machine provided by the present disclosure.
Figure 10:
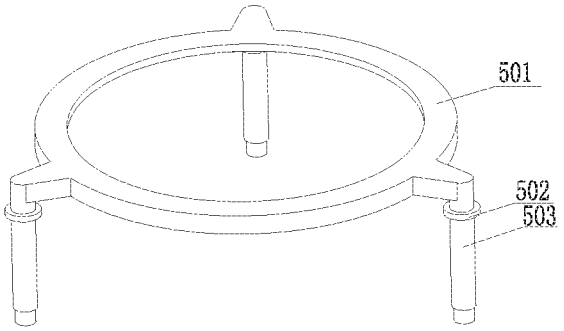
FIG. 10 is a top three-dimensional structural diagram of a pull ring component of a cleaning-free water-saving washing machine provided by the present disclosure.
Figure 11:
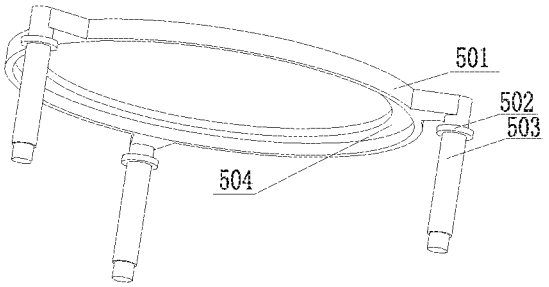
FIG. 11 is a bottom three-dimensional structural diagram of a pull ring component of a cleaning-free water-saving washing machine provided by the present disclosure.

Specifically, as shown in FIG. 8 and FIG. 9, the sealing jacket 400 comprises an annular jacket body and a plurality of connecting arms 401 which are arranged along the circumferential direction of the annular jacket body. The annular jacket body sleeves the outside of the inner barrel shaft 702, mounting holes 405 are formed in the connecting arms 401, and the sealing plugs 407 are arranged inside the annular jacket body. The sealing plugs 407 and the drainage holes are in correspondence in both position and quantity, and preferably, 1-6 sealing plugs 407 are arranged.

Shown as FIG. 2, according to the embodiment, the sealing component further comprises columnar mounting elements 202 and elastic pieces; the columnar mounting elements 202 run through the mounting holes 405, so as to mount the sealing jacket 400 at the outside of the bottom of the inner barrel 200; one end of the elastic piece is fixed while the other end abuts against the sealing jacket 400, so as to keep the drainage holes 204 closed. According to the embodiment, the sealing jacket 400 is arranged at the bottom of the inner barrel 200 by virtue of the columnar mounting elements 202, and the sealing jacket 400, relative to the columnar mounting elements 202 can do motions up and down; therefore, the wall thickness of the connecting arm 401 of the sealing jacket 400 is less than the length of the columnar mounting element 202.

Preferably, at least three connecting arms 401, which are uniformly distributed along the circumferential direction of the annular sleeve body, are arranged; the columnar mounting elements 202 and the connecting arms 401 are identical in quantity. Therefore, the stability of the sealing jacket 400 mounted at the bottom of the inner barrel 200 can be guaranteed and circumferential rotation of the sealing jacket is limited, and the sealing plugs 407 of the sealing jacket 400 are opposite to the drainage holes 204. And subsequently, a purpose of opening and closing the drainage holes 204 can be achieved.

According to a preferred embodiment, the elastic pieces are compression springs 1700. The compression springs 1700 sleeve the columnar mounting elements 202, one end of each compression spring 1700 abuts against the columnar mounting element 202 and the other end abuts against the connecting arm 401 of the sealing jacket 400. According to the embodiment, the sealing jacket 400 is stressed by pressure of the compression springs 1700, so that the drainage holes 204 are sealed by the sealing plug 407. In a drainage process, the sealing plugs 407, which are pulled by the pull ring component 500, are moved downwards and escape from the drainage holes 204, so that the drainage holes 204 are opened to implement drainage.

According to a preferred embodiment, the pull ring component 500 comprises an annular body 501 and pull rods 503. The annular body 501 sleeves the sealing jacket 400. The sealing jacket 400 is provided with a limiting portion which is used for limiting the annular body 501 from escaping in an axial direction of the inner barrel. The pull rods 503 are distributed along the circumferential direction of the annular body 501, one end of each pull rod 503 is connected to the annular body 501, and a driving device, which is used for driving the pull rod to do axial motion along the inner barrel, is connected to the other end of each pull rod.

In order to pull the sealing jacket 400 by virtue of the pull ring component 500, the annular body 501 of the pull ring component 500 extends inwards, so that a limiting wall 504 is formed. And an annular rib is arranged on the outer wall of the annular jacket body of the sealing jacket 400, so that a convex ring 402 is formed. The outer diameter of the region, excluding the convex ring 402, of the annular jacket body of the sealing jacket 400 is less than the inner diameter of the limiting wall 504, so that rotation of the sealing jacket 400 relative to the pull ring component 500 can be guaranteed. The outer diameter of the convex ring 402 of the annular jacket body of the sealing jacket 400 is greater than the inner diameter of the limiting wall 504, so that motion of the sealing jacket 400 under the pulling of axial motion of the pull ring component 500 along the inner barrel can be guaranteed.

Furthermore, guide pillar holes 105 are formed in the bottom of the outer barrel 100, and the pull rods 503 run through the guide pillar holes 105 and are connected to the driving device. And corrugated sealing sleeves 1900, which have the sealing function, are arranged between the pull rods 503 and the guide pillar holes 105. According to the embodiment, the driving device is arranged outside the outer barrel 100, so as to prevent water invasion, and sealing can be prevented. The pull rods 503 run out of the outer barrel 100 and undergo dynamic sealing of the corrugated sealing sleeves 1900, so that a phenomenon of water leakage can be prevented. Furthermore, limiting bulges 502 are arranged on the pull rods 503; and the corrugated sealing sleeves 1900 abut against the limiting bulges 502, so as to limit the corrugated sealing sleeves 1900 from falling and to guarantee sealing performance.

As a preferred embodiment, the driving device provided by the present disclosure comprises an electromagnetic coil 1500 and an annular magnet 2000 which are coaxially arranged; and the pull rods 503 are connected to the annular magnet 2000. Specifically, the electromagnetic coil 1500 and the annular magnet 2000 sleeve one axial. The electromagnetic coil 1500 is fixed, and the annular magnet 2000 is arranged at the upper side of the electromagnetic coil 1500 at an interval and is capable to slide relatively along the axial, so that the annular magnet 2000, attracted by magnetic force of the electromagnetic coil 1500, slides downwards in an axial direction when a magnetic field is formed by the electromagnetic coil 1500 which is electrified, and the pull ring component 500, under the driving of the annular magnets 2000, is moved downwards.

According to the embodiment, the region, which is lower than the highest water level of the washing machine, is a hole-free barrel wall. Therefore, a water-leakage preventing inner barrel is surrounded by the inner barrel flange 203, the inner barrel bottom and the barrel body. And a balance ring is arranged on a feeding port in the upper side of the barrel body. The barrel body, the barrel bottom and the inner barrel flange 203 constitute the water-leakage preventing inner barrel, and the inner barrel is used for storing water so as to wash clothes.

According to the embodiment, the drainage holes are such positioned that washing water, which is generated from washing/rinsing, cannot be discharged from the drainage holes, and water, which is generated from dewatering, can be discharged to the outer barrel from the dewatering holes and can be further discharged out.

According to the embodiment, the drainage holes are arranged in a circle in the end, close to the balance ring, of the barrel body; the inner side part of the balance ring extends into the barrel body, and the drainage holes are aligned with the balance ring, so that the circle of dewatering holes can be sheltered by the balance ring; and the inner barrel looks free from holes.

According to the embodiment, the washing machine further comprises a reduction clutch, the reduction clutch comprises an inner barrel shaft 702 and a pulsator shaft 701. The pulsator shaft 701 runs through the bottom of the outer barrel 100 and the bottom of the inner barrel 200 and is connected to a pulsator 300 which is arranged at the bottom of the inner barrel 200. And the pulsator is rotated under the driving of the pulsator shaft 701, so as to stir washing water to wash clothes. The inner barrel shaft 702 is a shaft sleeve which sleeves the outside of the pulsator shaft 701, and the inner barrel shaft 702 runs through the bottom of the outer barrel 100 and is fixedly connected to the inner barrel flange 203 of the inner barrel 200, so as to drive the inner barrel 200 to rotate.

According to the embodiment, a drainage port 101 is arranged at the bottom of the outer barrel 100, and the drainage port 101 is connected to the drainage pipe 800, so as to discharge the washing water out of the washing machine.

In addition, according to the embodiment, the cleaning-free water-saving washing machine can implement water level detection by virtue of such modes as weighing, ultrasonic detection and the like in a water intake process.

Meanwhile, according to the embodiment, a control method of the cleaning-free water-saving washing machine comprises:

In a washing or a rinsing process, keeping the drainage holes closed by virtue of the sealing component, and space between the inner barrel and the outer barrel free of water;

in a drainage process of the washing machine, controlling the pull ring component to do axial motion along the inner barrel shaft, and pulling the sealing component to move by virtue of the pull ring component, so as to open the drainage holes to conduct drainage; and in a dewatering process of the washing machine, resetting the sealing component so as to close the drainage holes.

According to the control method of the cleaning-free water-saving washing machine provided by the embodiment, in the washing or a rinsing process, a space between the inner barrel and the outer barrel is free from water, so that water-consuming amount of clothes washing is reduced, and moreover, dirt between the inner barrel and the outer barrel is prevented. Therefore, pollution to clothes is prevented, a washing effect is enhanced and users' experience is improved.

In the drainage process, the pull ring component is controlled to move along the inner barrel shaft. The sealing component, which is pulled by the pull ring component, is moved, so that the drainage holes are opened to conduct drainage, and meanwhile, such impurities as sand, generated from the washing process, can be also discharged, so that the interior of the inner barrel is kept clean.

In the dewatering process of the washing machine, the sealing component is reset so as to keep the drainage holes closed, therefore, the pull ring component 500 and the sealing jacket 400 are prevented from mutual contact, and subsequent abrasion is avoided, and stability in the dewatering process can be kept, and meanwhile, noise generation can be avoided.

According to the embodiment, in the dewatering process, water is thrown to the outer barrel 100 from the drainage holes in the upper side of the inner barrel through centrifugal force, and the water is discharged from the drainage port 101 of the outer barrel 100.

Embodiment II

Shown as FIG. 1-FIG. 13, the cleaning-free water-saving washing machine provided by the embodiment comprises:

an outer barrel 100;

an inner barrel 200, which is rotatably arranged in the outer barrel 100; and an inner barrel shaft 702, which is connected to the inner barrel 200 so as to drive the inner barrel 200 to rotate;

during a washing or a rinsing process, the inner barrel 200 serves as a water storage barrel;

drainage holes 204 are formed in the bottom of the inner barrel 200, and a sealing device is arranged at the outside of the bottom of the inner barrel 200. The sealing device comprises a sealing component and a pull ring component 500 which sleeve the outside of the inner barrel shaft, the pull ring component 500 is connected to the sealing component in a relatively rotating mode, and the sealing component, pulled by the pull ring component 500, can do axial motion along the inner barrel 200, so that the drainage holes 204 can be opened/closed. One end of the sealing component is connected to the inner barrel in a sealed mode, and the other end, pulled by the pull ring component 500, is connected/disconnected to the outer barrel 100 in a sealed mode.

The washing machine further comprises a water level detection device, wherein the detection end of the water level detection device is connected to the interior of the sealing component.

According to the embodiment, the water level detection device communicates with the interior of the sealing component, in the water intake process, the pull ring component 500 is controlled to pull the sealing component to do axial motion along the inner barrel so as to open the drainage holes, and washing water enters the sealing component, so that water level detection is implemented by virtue of the water level detection device.

In addition, one end of the sealing component is in sealing connection with the inner barrel and the other end, pulled by the pull ring component is in sealing connection or disconnection with the outer barrel. Therefore, water, which is supplied, is kept in the sealing component only, and the washing water is prevented from entering the region, excluding the interior of the sealing component, between the inner barrel 200 and the outer barrel 100. Subsequently, water-consuming amount of clothes washing is reduced. Moreover, dirt growth between the inner barrel and the outer barrel is prevented, pollution to clothes is avoided, a washing effect is enhanced and users' experience is improved.

Specifically, according to the embodiment, the sealing component comprises a sealing jacket 400; the sealing jacket 400 sleeves outside the inner barrel shaft 702; the sealing jacket 400 is arranged at the outside of the bottom of the inner barrel 200, capable of doing axial motion along the inner barrel. One end of the sealing jacket 400 is in sealing connection to the inner barrel 200 and the other end, pulled by the pull ring component, is in sealing connection to the outer barrel 100; and the sealing jacket 400 is provided with sealing plugs 407 which are matched with the drainage holes.

Furthermore, in order to achieve sealing connection between the sealing component and the inner barrel 200, an annular sealing rib 201 is arranged at the outer side of the bottom of the inner barrel 200, and the drainage holes 204 are arranged in the annular sealing rib 201. An annular groove 408 is arranged in the end, close to the bottom of the inner barrel, of the sealing jacket 400; the annular sealing rib 201 is inserted into the annular groove 408 and are in sealing connection; and in a process that the sealing jacket 400 does axial motion along the inner barrel, the annular sealing rib 201 is kept to do motion in the annular groove 408 and a water sealing effect is achieved.

Otherwise, elastic corrugated sealing sleeves are arranged at the end, close to the bottom of the inner barrel 200, of the sealing jacket 400; and the elastic corrugated sealing sleeves are in fixed sealing connection to the bottom of the inner barrel.

Specifically, according to the embodiment, the sealing jacket comprises an annular jacket body and a plurality of connecting arms 401 which are arranged along the circumferential direction of the annular jacket body; the annular jacket body sleeves the outside of the inner barrel shaft 702; mounting holes 405 are arranged in the connecting arms 401; and the sealing plugs 407 are arranged in the annular jacket body.

The sealing component further comprises columnar mounting elements 202 and elastic pieces; the columnar mounting elements 202 run through the mounting holes 405, so as to mount the sealing jacket 400 at the outside of the bottom of the inner barrel 200; one end of the elastic piece is fixed while the other end abuts against the sealing jacket 400, so as to keep the drainage holes 204 closed.

The annular groove 408 is arranged at the end, close to the bottom of the inner barrel, of the annular jacket body.

According to the embodiment, the end, close to the bottom of the inner barrel, of the annular jacket body, comprises an upper annular inner jacket body 403 and an upper annular outer jacket body 406 which are coaxially arranged. The bottoms of the upper annular inner jacket body 403 and the upper annular outer jacket body 406 are connected by virtue of a connecting rib, and an annular groove 408 is formed between the upper annular inner jacket body 403 and the upper annular outer jacket body 406.

Furthermore, in order to achieve sealing connection between the sealing component and the outer barrel 100, the sealing device further comprises a sealing box cover 600. The sealing box cover 600 is arranged at the bottom of the outer barrel 100 in a sealing mode, so that a water intake cavity is formed; a sealing box cover 600 is provided with a connecting port 601. And the end, which is close to the outer barrel, of the sealing jacket, is inserted into the connecting port 601 of the sealing box cover 600, so that sealing connection is achieved.

According to the embodiment, a water intake cavity can be formed by the sealing box cover 600 by integrally molding the outer barrel 100. Or the sealing box cover 600 serves as an independent component and is arranged on the inner wall of the bottom of the outer barrel 100 in a sealing mode by virtue of a sealing strip 1800, and a water intake cavity is formed between the sealing box cover and the outer barrel 100.

In order to conduct water level detection by virtue of the water level detection device, the detection end of the water level detection device is connected to the water intake cavity.

Figure 12:
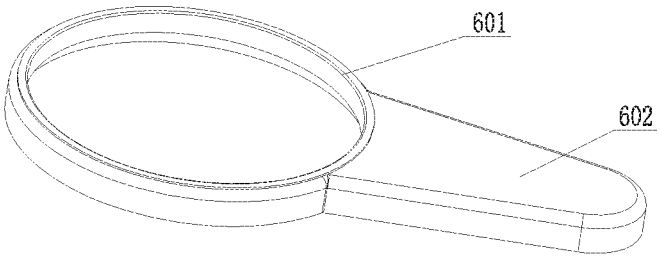
FIG. 12 is a top three-dimensional structural diagram of a sealing box cover of a cleaning-free water-saving washing machine provided by the present disclosure.
Figure 13:
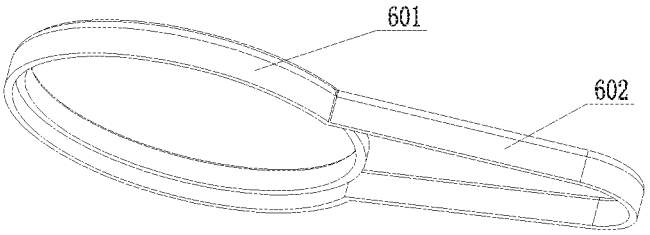
FIG. 13 is a bottom three-dimensional structural diagram of a sealing box cover of a cleaning-free water-saving washing machine provided by the present disclosure.

Shown as FIG. 12 and FIG. 13, the sealing box cover 600 comprises a box cover 602 which is arranged at one side of the connecting port 601. The box cover 602 is in sealing connection to the bottom of the outer barrel 100, so that the water intake cavity is formed, and the connecting port 601 communicates with the water intake cavity. A first drainage port 103 is arranged, corresponding to the box cover 602, in the bottom of the outer barrel 100. A first drainage valve 1000 is arranged on the first drainage port 103, and the water outlet end of the first drainage valve 1000 is connected to a drainage pipe 800 of the washing machine. According to the embodiment, the water intake cavity communicates with the drainage pipe 800, and the water intake cavity is controlled opened or closed by the first drainage valve 1000, so that washing water, which enters the sealing jacket 400 in the water intake process, can be discharged in one aspect. And the first drainage valve 1000 can be opened in the drainage process in the other aspect, and meanwhile, the drainage holes are opened, so as to implement drainage.

Furthermore, according to the embodiment, the bottom of the outer barrel 100 sinks towards outside, so that a sealing groove 102 is formed, and the sealing box cover 600 is arranged on the sealing groove 102 in a sealed mode, so that a water intake cavity is formed. Preferably, the first drainage port 103 is arranged on the sealing groove 102. Preferably, the detection end of the water level detection device is connected to the sealing groove 102 by virtue of a connecting pipe 1100. A mounting hole for inner barrel shaft 104, in which the inner barrel shaft 702 is inserted, is additionally arranged in the sealing groove 102.

According to a preferred embodiment, the water level detection device comprises an air chamber 1200, a pressure pipe 1300 and a water level sensor 1400, the lower end of the air chamber communicates with the water intake cavity in the sealing box cover, and an air chamber nozzle 1201 of the air chamber 1200 communicates with the water level sensor 1400 by virtue of the pressure pipe 1300.

According to a preferred embodiment, the pull ring component 500 comprises an annular body 501 and pull rods 503, the annular body 501 sleeves the sealing jacket 400, the sealing jacket 400 is provided with a limiting portion which is used for limiting the annular body 501 from escaping along an axial direction of the inner barrel. The pull rods 503 are distributed along the circumferential direction of the annular body 501, one end of each pull rod 503 is connected to the annular body 501, and a driving device, which is used for driving the pull rod to do axial motion along the inner barrel, is connected to the other end.

Specifically, the driving device is arranged at the outside of the bottom of the outer barrel 100. Guide pillar holes 104 are arranged in the bottom of the outer barrel 100. The pull rods 503 run through the guide pillar holes 105 and are connected to the driving device, and corrugated sealing sleeves 1900, which have the sealing function, are arranged between the pull rods 503 and the guide pillar holes 105.

According to the embodiment, the control method of the cleaning-free water-saving washing machine, comprising:

in a water intake process of the washing machine, controlling the pull ring component to do axial motion along the inner barrel and pulling the sealing component to do motion by virtue of the pull ring component, so as to open the drainage holes, therefore, water enters the sealing component and water level detection is implemented by the water level detection device;

in a washing or a rinsing process of the washing machine, closing the drainage holes by virtue of the sealing component, wherein the inner barrel is a water storage barrel;

in a drainage process of the washing machine, controlling the pull ring component to do axial motion along the inner barrel, so that the sealing component, which is pulled by the pull ring component, is moved, and the drainage holes are opened to conduct drainage; and in a dewatering process of the washing machine, resetting the sealing component so as to close the drainage holes.

According to the embodiment, the water level detection device communicates with the interior of the sealing component; in the water intake process, the pull ring component is controlled to pull the sealing component to do axial motion along the inner barrel so as to open the drainage holes; and washing water enters the sealing component, so that water level detection is implemented by virtue of the water level detection device.

According to the control method of the cleaning-free water-saving washing machine provided by the embodiment, in the washing or a rinsing process, a space between the inner barrel and the outer barrel is free from water, so that water-consuming amount of clothes washing is reduced, and moreover, dirt growth between the inner barrel and the outer barrel is prevented; therefore, clothes pollution is prevented, a washing effect is enhanced and users' experience is improved. In the drainage process, the pull ring component is controlled to do axial motion along the inner barrel and the sealing component, which is pulled by the pull ring component, is moved, so that the drainage holes are opened to conduct drainage; and meanwhile, such impurities as sand, generated from the washing process, can be also discharged, so that the interior of the inner barrel is kept clean.

In the dewatering process of the washing machine, the sealing component is reset so as to keep the drainage holes closed; therefore, the pull ring component 500 and the sealing jacket 400 are prevented from making into contact, and subsequent abrasion is avoided; and stability in the dewatering process can be kept, and meanwhile, noise generation can be avoided.

According to the embodiment, in the dewatering process, water is thrown to the outer barrel 100 from the drainage holes in the upper side of the inner barrel through centrifugal force, and the water is discharged from the drainage port 101 of the outer barrel 100.

Described above is only part of the better embodiments of the present disclosure, and is not the limitation to the present disclosure in any form. Although the present disclosure has already disclosed its better embodiments as mentioned above, they are not used to limit the present disclosure. Any technician who is familiar with the present disclosure, within the scope of the technical solution of the present disclosure, can make a little change or modify the present disclosure to an equivalent embodiment with the equivalent change. However, any technical content that is not beyond the technical solution of the present disclosure, any simple modification, equivalent change and modification made to the aforesaid embodiment according to the technical substance of the present disclosure, are within the technical solution of the present disclosure

The invention claimed is:

1. A washing machine, comprising:

an outer barrel;

an inner barrel rotatably arranged in the outer barrel wherein a drainage hole is formed in a bottom of the inner barrel, an inner barrel shaft connected to the inner barrel for driving the inner barrel to rotate, during a washing process or a rinsing process, the inner barrel serving as a water storage barrel, and a space between the inner barrel and the outer barrel being free from water, a sealing device arranged at an outside of the bottom of the inner barrel, the sealing device including a sealing component sleeving on the inner barrel shaft and a pull ring component wherein the sealing component is installed at the bottom of the inner barrel and is configured to rotate along with the inner barrel, the pull ring component is connected with the sealing component in a relatively rotating mode, and the sealing component is configured to be pulled by the pull ring component in an axial motion along the inner barrel, so that the drainage hole is controlled to be opened or closed, the sealing component includes a columnar mounting element, an elastic piece and a sealing jacket including an annular jacket body and a plurality of connecting arms arranged along a circumferential direction of the annular jacket body, the annular jacket body is configured to sleeve on the inner barrel shaft;

mounting holes formed in the connecting arms; and a sealing plug arranged in the annular jacket body to match with the drainage hole, wherein the sealing jacket is installed at the outside of the bottom of the inner barrel by the columnar mounting element running through the mounting holes, and a first end of the elastic piece is fixed, and a second end of the elastic piece abuts against the sealing jacket so as to close the drainage hole.

2. The washing machine according to claim 1, wherein the inner barrel includes the inner barrel bottom and an inner barrel flange connected to the inner barrel bottom, a connecting portion for connecting with the inner barrel shaft, is arranged in a center of the inner barrel, and the drainage hole is formed in the inner barrel bottom and/or the inner barrel flange outside the connecting portion.

3. The washing machine according to claim 1, wherein a compression spring is as the elastic piece, the compression spring sleeves on the columnar mounting element, a first end of the compression spring abuts against the columnar mounting element, and a second end abuts against the connecting arm of the sealing jacket.

4. The washing machine according to claim 1, wherein the pull ring component includes an annular body and pull rods, the annular body sleeves on the sealing jacket, the sealing jacket is provided with a limiting portion for preventing the annular body from escaping along an axial direction of the inner barrel shaft, the pull rods are distributed along a circumferential direction of the annular body, a first end of each pull rod is connected to the annular body, and a second end of each pull rod is connected with a driving device for driving the pull rods to do axial motion along the inner barrel.

5. The washing machine according to claim 4, wherein the driving device is arranged at the outside of the bottom of the outer barrel, guide pillar holes are formed in the bottom of the outer barrel, the pull rods are connected with the driving device through the guide pillar holes respectively, and corrugated sealing sleeves are arranged between the pull rods and the guide pillar holes for sealing.

6. The washing machine according to claim 4, wherein the driving device includes an electromagnetic coil and an annular magnet coaxially arranged with the electromagnetic coil; and the pull rods are connected to the annular magnet.

7. The washing machine according to claim 1, wherein a part of a sidewall of the inner barrel, being lower than a highest water level of the washing machine, is a hole-free barrel wall.

8. The washing machine according to claim 3, wherein the pull ring component includes an annular body and pull rods, the annular body sleeves on the sealing jacket, the sealing jacket is provided with a limiting portion for preventing the annular body from escaping along an axial direction of the inner barrel shaft, and the pull rods are distributed along a circumferential direction of the annular body; a first end of each pull rod is connected to the annular body, and a second end of each pull rod is connected with a driving device for driving the pull rods to do axial motion along the inner barrel.

9. A control method of the washing machine according to claim 1, comprising:

in a washing or a rinsing process of the washing machine, closing the drainage hole by the sealing component, and keeping a space between the inner barrel and the outer barrel under a water-free state;

in a drainage process of the washing machine, controlling the pull ring component to do axial motion along the inner barrel, pulling the sealing component to move by the pull ring component, and opening the drainage hole to conduct drainage; and in a dewatering process of the washing machine, resetting the sealing component so as to close the drainage hole.

* * * * *